United States Patent [19]

Abegg et al.

[11] Patent Number: 4,632,714

[45] Date of Patent: Dec. 30, 1986

[54] MICROCELLULAR COMPOSITE ENERGETIC MATERIALS AND METHOD FOR MAKING SAME

[75] Inventors: M. Taylor Abegg, Salt Lake City; John A. Peterson, Brigham City, both of Utah

[73] Assignee: Megabar Corporation, Ogden, Utah

[21] Appl. No.: 777,832

[22] Filed: Sep. 19, 1985

[51] Int. Cl.[4] ..... C06B 45/00

[52] U.S. Cl. ..... 149/2; 149/21; 149/45; 149/46; 149/61; 149/76; 149/83; 149/88; 149/92

[58] Field of Search ..... 149/2, 21, 45, 46, 61, 149/76, 83, 88, 92

[56] References Cited

U.S. PATENT DOCUMENTS

| | | | |
|---|---|---|---|
| 4,401,490 | 8/1983 | Alexander et al. | 149/2 |
| 4,473,418 | 9/1984 | Bampfield et al. | 149/2 |
| 4,491,489 | 1/1985 | Ellis et al. | 149/2 |
| 4,511,412 | 4/1985 | Kakino et al. | 149/2 |
| 4,552,597 | 11/1985 | Abegg et al. | 149/2 |
| 4,555,277 | 11/1985 | Scribner | 149/88 |

*Primary Examiner*—Stephen J. Lechert, Jr.
*Attorney, Agent, or Firm*—K. S. Cornaby

[57] ABSTRACT

Essentially anhydrous energetic compositions, including explosives, propellants, flares, and gas generators, are initially formed at process temperatures above the solidification temperature of contained oxidizer salts as stable, melt-in-fuel emulsions having a continuous fuel phase and a discontinuous molten oxidizer phase. Surfactants are employed which cause the compositions to retain general fuel phase continuity and oxidizer phase discontinuity upon solidification. The final product is a firm or solid emulsion generally characterized by an intimate dispersion of discrete solid oxidizer cells in a fuel continuum, the product having excellent storage stability and water resistance.

52 Claims, No Drawings

MICROCELLULAR COMPOSITE ENERGETIC MATERIALS AND METHOD FOR MAKING SAME

BACKGROUND OF THE INVENTION

Aqueous emulsion explosives of the water-in-oil type are well known, as in U.S. Pat. Nos. 3,161,551; 3,164,503 and 3,447,978. U.S. Pat No. 4,248,644 teaches non-aqueous melt-in-fuel emulsion technology wherein essentially anhydrous molten salts are emulsified with an immiscible hydrocarbon fuel. The hydrocarbon fuel forms the continuous phase and the molten oxidizer forms the discontinuous phase. A fuel-continuous emulsion in obtained which is grease-like or extrudable at ambient temperatures.

Until recently, developments in non-aqueous melt-in-fuel emulsion explosives have been directed toward soft or pumpable explosives for commercial blasting operations. However, U.S. patent applications Ser. Nos. 578,177; 578,178; 578,179; 597,415 and 597,416 teach unstable melt-in-fuel emulsions which are castable. These emulsions are formulated so as to be unstable; that is, when cooled, the continuous phase is disrupted as the discontinuous droplets of molten oxidizer crystallize and knit together, forming a rigid structure.

Such compositions derived from unstable emulsions suffer from several disadvantages: The carefully regulated intimacy of fuel and oxidizer mixing achieved during process refinement is subject to the disruptive effects of oxidizer crystal growth and interknitting with potentially adverse effects on performance, sensitivity and storage life of the product. Further, the disruption of the fuel continuum increases the exposure of the oxidizer salts to the effect of moisture which also adversely affects both storage life and performance.

It has not been apparent heretofore that castable energetic compositions can be made from stable non-aqueous emulsions which retain oxidizer phase discontinuity during solidification of the individual oxidizer cells. In contrast to cast compositions made from unstable emulsions, the compositions of the present invention become solid, rigid or firm following cooling without significant disruption of the fuel phase continuum or substantial interknitting of the separate oxidizer cells. As expolsives, the shear sensitivity of the compositions may be reduced and the safety enhanced through internal lubrication by the fuel continuum. As propellants, elastomeric properties may be achieved superior to those of compositions exhibiting the more brittle, interknit crystalline structure resulting from unstable emulsions. In all such castable compositions made from stable emulsions, whether explosives, propellants, flares or gas generators, a high degree of fuel and oxidizer intimacy is maintained on solidification; and superior water resistance and shelf life result from preservation of the fuel continuum.

It is the principal objective of this invention to obtain solid, rigid or firm energetic compositions from stabe non-aqueous emulsions such that the fuel continuous geometry and intimacy of ingredients characteristic of the fluid emulsion is maintained in the final solid product. It is another objective to formulate the compositions in a manner which will permit continuous processing, cooling, optional admixing of additives, and loading or packaging, before solidification. Another objective is to achieve supercooling to or near to ambient temperatures before solidification in order to reduce cast defects resulting from thermal shrinkage. A further objective is to achieve water resistance in the compositions. Other objectives are to achieve internal lubrication and reduced shear sensitivity in explosive compositions and substantially to prevent interknitting of oxidizer crystals so as to achieve improved elastomeric properties in propellants and plastic bonded explosives.

Because the oxidizer cells in the final product are typically sub-micron in certain dimensions, the products are referred to as microcellular composite energetic materials.

Since the discontinuous phase of the fluid emulsion as first formed remains substantially discontinuous in the final solidified product, and since the continuous phase remains substantially continuous in the final solidified product, microcellular composite formulations can also be referred to as solid emulsions. This term is intended to include those microcellular formulations which have solidified as a result of either or both phases having become solid.

SUMMARY OF THE INVENTION

This invention relates to essentially anhydrous energetic compositions, including explosives, propellants, flares and gas generators. The compositions are initially formed at process temperatures above the solidification temperature of contained oxidizer salts as stable, essentially anhydrous emulsions having a continuous fuel phase and a discontinuous molten oxidizer phase. By means of selected surfactants and the degree and duration of shear imparted during mixing, emulsion stability is retained during solidification. The choice of surfactants and the extent of shear also influence the degree to which the material supercools, typically to or near to ambient temperature, before solidification. Upon hardening the compositions retain general fuel phase continuity and oxidizer phase discontinuity. The final product is a firm or solid composition characterized by an intimate dispersion of discrete solid oxidizer cells within a substantially continuous fuel phase. Structural rigidity results from the high ratios of solid oxidizers to fuels and the consequent close packing of the non-spherical oxidizer cells. Experimentation has shown that such structural rigidity occurs regardless of whether the oxidizer cells are crystalline or amorphous in the final solid state. The use of polymeric fuels may also contribute to the structural rigidity and integrity of the final product.

The methods disclosed in the invention permit the manufacturing of numerous formulations from separate non-hazardous components on a continuous basis. Such continuous processing minimizes both the quantity of neat energetic material in process and the residence time of the material at elevated manufacturing temperatures. Safety is greatly enhanced since only small quantities are in process at a given time. Microcellular formulations can therefore employ molten oxidizers having melting temperatures considerably in excess of those considered practical for conventional melt-cast operations. It has been found practical to make microcellular composites involving oxidizers with melt temperatures as high as 250° C. Nevertheless, supercooling has been achieved to ambient or near ambient temperature before solidification takes place.

It will be apparent from the foregoing that a wide variety of ingredients may be used in microcellular compositions, including many which hitherto have been regarded as impractical or unsafe, as well as a variety of low cost ingredients (which can typically be selected to form the bulk of the composition with significant cost savings).

Oxidizer salts which may be used in microcellular compositions, singly or in combination, include the nitrite, nitrate, chlorate and perchlorate salts of lithium, sodium, potassium, magnesium, calcium, strontium, barium, copper, zinc, manganese, lead and the ammonium counterparts. Particularly attractive for ease and safety of handling are combinations of such oxidizer salts which form melts at temperatures below the melting points of the individual salts present. Many such combinations have been found which reduce melting temperatures to levels convenient for processing.

The oxidizer melt may be comprised of soluble ingredients in addition to the molten inorganic oxidizer salts, including soluble self-explosives such as the nitrate or perchlorate adducts of ethanolamine, ethylenediamine and higher homologs; aliphatic amides such as formamide, acetamide and urea; urea nitrate and urea perchlorate; nitroguanidine, guanidine nitrate and perchlorate, and triaminoguanidine nitrate and perchlorate; polyols such as ethylene glycol, glycerol, and higher homologs; ammonium and metal salts of carboxylic acids such as formic and acetic and higher acids; sulfur containing compounds such as dimethylsulfoxide; and mixtures of the above.

These added ingredients may be selected to take advantage of their properties as secondary fuels or oxidizers and as melting point depressants, thus enabling supplementary means for achieving a suitable oxygen balance in the final product, typically from +5% to −50% relative to carbon dioxide, and suitably low melting points, typically within the range from 70° C. to 200° C., preferably from 70° C. to 140° C.

A wide variety of fuels, used separately and in combination, is similarly applicable to microcellular compositions. Almost any organic material can be used to constitute the fuel phase of the emulsion, so long as it is liquid at processing temperatures. Aliphatic fuels are suitable, including waxes and oils, as are nonaliphatic fuels. Both monomeric and polymeric materials are suitable for use, depending upon their physical and chemical properties. Particulate metallic fuels and soluble and insoluble self-explosive fuels may be added before or after emulsification. In all cases the oxygen balance of the composition is easily adjusted, and the fuel phase typically falls within the range from 2 to 25 percent by weight, preferably from 3 to 15 percent by weight, of the composition.

Microcellular formulations lend themselves particularly to the use of polymeric fuels, crosslinkable polymers, and polymerizable fuels. Microcellular formulations which make use of polymeric fuels are especially applicable to plastic bonded explosives, rocket propellants and gas generators, all of which require resiliency in the final product. Many polymer families and polymerization routes are available.

Polymers that are thermoplastic are useful as fuels in compounding microcellular compositions. The elastomer is heated until molten and is then blended with the molten oxidizer to form an emulsion. Upon cooling, either or both of the fuel and oxidizer phases may be solid in the final microcellular product. Various low melting point polyethylenes have been used with success and impart a range of mechanical properties to the final products, which are highly water resistant. Microcellular materials made in this way require no separate curing reaction.

Prepolymers are also suitable as fuels. The prepolymer and crosslinker are introduced in the fuel phase, and after emulsification of the material and dispersion of the discrete oxidizer cells has occured, the curing reaction proceeds to a completely cross-linked structure with favorable elastomeric properties and a high degree of storage and dimensional stability.

The ultimate stability of energetic composite materials is largely controlled by the fuel phase. Thermal stability can be enhanced by choosing the oil phase from the silicone, perfluorinated or other synthetic oils. These are useful in compounding formulations with specially desired properties that would not be available otherwise.

A wide variety of surfactants, including emulsifiers and crystal habit modifiers, is applicable. Surfactants are selected to be chemically compatible with the other ingredients in the composition, thermally stable, and effective in producing stable emulsions of the fuel and oxidizer phases. Surfactants which are effective in producing emulsions which supercool and remain stable during solidification can be selected from the groups consisting of (a) cationic surfactants, such as, oleylamine, cocoamine, stearylamine, dodecylamine, hexylamine, oleylamine acetate, oleyl-N-propylamine acetate, dodecylamine acetate, octadecylamine acetate, oleylamine linoleate, soyaamine linoleate and oleyloxazoline derivatives; (b) anionic surfactants, such as, sodium oleate, sodium lauryl sulfate, sodium dodecylbenzene sulfonate, sodium dimethylnaphthalene sulfonate, stearic acid, linoleic acid, polyethoxylated fatty acids, alkylaryl sulfonic acids, sodium dioctyl sulfosuccinate, and potassium alphaolefin sulfonate; (c) non-ionic surfactants, such as, sorbitan monooleate, sorbitan monopalmitate, sorbitan sesquioleate, lecithin, and alkylphenoxypolyethoxyethanols; and (d) amphoteric surfactants, such as, N-coco-3-aminobutanoic acid, the dodecylamine salt of dodecylbenzene sulfonic acid, and mixtures of the above.

In the case of surfactants containing straight-chain moieties, such as the aliphatic amines, $RNH_2$, The R-groups may contain 6 or more carbon atoms, preferably 12 to 20 carbon atoms. Emulsifiers containing saturated or unsaturated hydrocarbon chains can be used, as can emulsifiers selected from the group consisting of aromatic or alkylaryl hydrocarbons.

Surfactants which also function as crystal habit modifiers are helpful because of their added influence upon nucleation and crystal growth. Those selected from the dialkylnaphthalene sulfonates are particularly useful for inhibiting dendritic crystal growth.

Other ingredients may be added for density control or sensitization, such as, microballoons, perlite, fumed silica, entrained gas or gas generated in situ.

DETAILED DESCRIPTION OF PREFERRED EMBODIMENTS

In general, microcellular compositions are formed by first preparing a melt of inorganic oxidizer salts, with or without added soluble ingredients. The molten oxidizer phase ingredients are then mechanically blended with molten fuel phase ingredients, and the mixture is subjected to vigorous, high shear agitation until a uniform, stable, oil-continuous emulsion is formed in which discrete molten oxidizer cells constitute the discontinuous phase. Solid particulate fuels or sensitizing materials such as self-explosives, may be added before or after the emulsion is formed. By proper selection of ingredients and processing conditions the molten oxidizer cells can be made to supercool before solidification as crystalline or amorphous solids. While still fluid the mixture is castable, that is, it can be poured or pumped into containers where subsequent solidification takes place resulting in a hard, rigid or firm product.

Examples of microcellular composite explosives are presented in Table I. The compositions in the table were prepared, as described above, in 300 g. batches at temperatures not less than 10° C. above the melting point of the combined salts. The molten oxidizer was added to the heated fuel, and the ingredients were stirred with a stainless steel impeller at speeds between 1000 and 3000 rpm until an oil-continuous emulsion was formed. The emulsion was then further refined to reduce the size of the individual cells of the oxidizer phase to the desired dimensions. Microcellular compositions have also been made by adding the heated fuel to the molten oxidizer. In all cases the fuel-phase continuity of the original emulsion was substantially preserved during the hardening process, as was the oxidizer-phase discontinuity.

The solid final product has been studied by means of scanning electron microscopy at high magnifications. These photographs show the discrete nature of the solidified oxidizer cells and the extremely intimate relationship between fuels and oxidizers. The final products are characterized by closely packed, discrete, irregular microcells with rounded corners and edges, separated from each other by a thin film of the fuel-phase continuum. Comparisons of the size and shape of the microcells before and after solidification show no substantial changes in geometry.

The examples in Table I illustrate the broad range of ingredients which can be used in microcellular compositions. Formulations that are nitrate based, perchlorate based and based on mixtures of nitrates, perchlorates and other ingredients are presented.

Example 1 illustrates the use of an oxidizer miscible fuel and melting point depressant (urea) in combination with ammonium nitrate, sodium nitrate and potassium perchlorate as the oxidizer phase.

Example 2 is an all perchlorate eutectic combination of ammonium perchlorate and lithium perchlorate. Both examples illustrate sensitization by means of density control using microballoons.

Examples 3 and 4 illustrate eutectic combinations of ammonium nitrate with nitroguanidine and guanidine nitrate, with and without granular cyclotrimethylenetrinitramine (RDX) as a sensitizer.

Example 5 employs a single oxidizer salt, lithium perchlorate, as the oxidizer and illustrates the high temperatures at which certain microcellular composites can be made (236° C.).

Examples 6 and 7 employ eutectic combinations of ammonium nitrate and sodium perchlorate; the former containing only an immiscible fuel (mineral oil), the latter a melt-soluble fuel (glycerine) in addition to mineral oil. Example 8 also employs glycerine in the oxidizer phase and makes use of a ternary combination of oxidizer salts, namely ammonium nitrate, sodium nitrate and potassium perchlorate.

Examples 9 and 10 contain powdered aluminum as a secondary fuel. Both contain soluble molecular explosives made in situ (monoethanolamine nitrate and monoethanolamine perchlorate, respectively). Example 9 also contains granular RDX.

Examples 11, 12, 13 and 14 are combinations of ammonium nitrate with a perchlorate salt and a soluble compound explosive. Ethylenediamine dinitrate is used in mix numbers 11, 12 and 13, while monoethanolamine nitrate is used in number 14. Mix 12 contains cyclotetramethylenetetranitramine (HMX) and mix 13 RDX as sensitizers while mix 14 is sensitized with microballoons.

Examples 15, 16, 17 and 18 contain, respectively, polyethylene, a synthetic oil, a silicone oil, and a halogenated oil as fuels. These different fuels impart distinctly different physical properties to the final products. For example, the use of a thermoplastic elastomer, such as polyethylene, imparts an elastomeric property to the final product. The use of a polysiloxane as the fuel imparts a rubbery consistency to the final product. Elastomeric properties are mandatory in many explosive, propellant and gas generator applications.

Example 19 contains a eutectic mixture of potassium nitrite and lithium nitrate as the oxidizer phase with a combination of mineral oil and wax as the fuel. Example 20 contains a eutectic combination of lithium nitrate, sodium chlorate and potassium chlorate as the oxidizer phase with mineral oil as the fuel.

GLOSSARY OF TERMS USED IN TABLE I

Alk T=Alkaterge T (an oleyloxazoline derivative)
AE-O=Oleylamine
OAL=Oleylamine linoleate
AC-18D=Octadecylamine acetate
AC-HT=Hydrogenated tallow amine acetate
AE-12D=Dodecylamine (distilled)
SMO=Sorbitan monooleate
Petro AG=Sodium dimethylnaphthalene sulfonate
AE-SD=Soyaamine (distilled)
AC-T=Tallowamine acetate
TA=Tallow amine
MEAN=Monoethanolamine nitrate
MEAP=Monoethanolamine perchlorate
EDDN=Ethylenediamine dinitrate
NQ=Nitroguanidine
GN=Guanidine nitrate
L=Length
D=Diameter
VOD=Velocity of Detonation

TABLE 1

| Microcellular Compositions | | | | | | | | | | |
|---|---|---|---|---|---|---|---|---|---|---|
| | Mix No. | | | | | | | | | |
| | 1 | 2 | 3 | 4 | 5 | 6 | 7 | 8 | 9 | 10 |
| Ingredients (wt %) | | | | | | | | | | |
| $NH_4NO_3$ | 63.5 | | 66.2 | 53.0 | | 67.7 | 67.5 | 69.5 | 35.8 | |
| $NaNO_3$ | 9.0 | | | | | | | 13.9 | | |
| $KNO_3$ | | | | | | | | | | |
| $LiNO_3$ | | | | | | | | | | |
| $NH_4ClO_4$ | | 24.0 | | | | | | | | 19.6 |
| $NaClO_4$ | | | | | | 19.4 | 19.3 | | 6.5 | |

TABLE 1-continued

| Microcellular Compositions | | | | | | | | | | |
|---|---|---|---|---|---|---|---|---|---|---|
| $KClO_4$ | 7.0 | | | | | | | 5.0 | | |
| $LiClO_4$ | | 57.5 | | | 82.0 | | | | | 48.0 |
| $NaClO_3$ | | | | | | | | | | |
| $LiClO_3$ | | | | | | | | | | |
| $KNO_2$ | | | | | | | | | | |
| AlkT | | | | | | | | | | |
| AE-O | 3.0 | | | | | | | | 1.2 | |
| OAL | | 12.0 | | | | | | 0.5 | | |
| AC-18D | | | 1.0 | 0.8 | | | | | | |
| AC-HT | | | | | 8.5 | | | | | 2.0 |
| AE12D | | | | | | 1.0 | 0.8 | | | |
| SMO | | | | | | | | 0.5 | | |
| Petro AG | | | | | | 2.0 | 0.5 | | | |
| AE-SD | | | | | | | | | | |
| AC-T | | | | | | | | | | |
| TA | | | | | | | | | | |
| Petroleum Jelly | | | | | | | | | | |
| Mineral Oil | 7.0 | | 4.0 | 3.2 | | 6.9 | 1.2 | 1.3 | 1.9 | 4.0 |
| Wax | | 6.0 | | | 8.5 | | | | | |
| Silicone Oil[1] | | | | | | | | | | |
| Halogenated Oil[2] | | | | | | | | | | |
| Synthetic Oil[3] | | | | | | | | | | |
| Polyethylene[4] | | | | | | | | | | |
| Powdered Al | | | | | | | | | 18.0 | 20.0 |
| Urea | 9.0 | | | | | | | | | |
| Glycerine | | | | | | | 9.7 | 8.8 | | |
| MEAN | | | | | | | | | 16.6 | |
| MEAP | | | | | | | | | | 6.4 |
| EDDN | | | | | | | | | | |
| NQ | | | 14.4 | 11.5 | | | | | | |
| GN | | | 14.4 | 11.5 | | | | | | |
| Microballoons | 1.5 | 0.5 | | | 1.0 | 3.0 | 1.0 | 0.5 | | |
| RDX | | | | 20.0 | | | | | 20.0 | |
| HMX | | | | | | | | | | |
| Density (g/cm$^3$) | 1.20 1.65 | 1.38 | 1.50 | 1.30 | 1.20 | 1.32 | 1.48 | 1.74 | 2.07 | |
| Melting point. | 104 | 180 | 101 | 101 | 236 | 118 | 104 | 111 | 93 | 165 |
| Oxydizer Phase (°C.) | | | | | | | | | | |
| Charge dimensions, L/D (cm/cm) | 10/6.4 | 8/3.8 | 10/6.4 | 10/6.4 | 10/6.4 | 8/3.8 | 8/3.8 | 10/6.4 | 48/7.9 | 48/7.9 |
| Iniator (Cap No) | 8 | 8 | 8 | 8 | 8 | 8 | 8 | 8 | 8 | 8 |
| Booster | 30 g PETN | | 30 g Comp C-4 | 15 g Comp C-4 | | | | | 100 g Comp B | 100 g Comp B |
| Results: VOD (ka/sec) | | | | | | | | | 7.05 | 8.38 |
| Plate dent[5] | Pos | Pos | Neg | Pos | Pos | Pos | Pos | Pos | | |

| | Mix No. | | | | | | | | | |
|---|---|---|---|---|---|---|---|---|---|---|
| | 11 | 12 | 13 | 14 | 15 | 16 | 17 | 18 | 19 | 20 |
| Ingredients (wt %) | | | | | | | | | | |
| $NH_4No_3$ | 41.1 | 30.8 | 28.8 | 59.2 | 65.8 | 65.8 | 62.3 | 60.6 | | |
| $NaNO_3$ | | | | | 18.6 | 18.6 | 17.7 | 17.2 | | |
| $KNO_3$ | | | | | | | | | | |
| $LiNO_3$ | | | | | | | | | 30.5 | 31.6 |
| $NH_4ClO_4$ | | | | | | | | | | |
| $NaClO_4$ | | | | 10.6 | | | | | | |
| $KClO_4$ | 7.3 | 5.5 | 5.1 | | 7.6 | 7.6 | 7.2 | 7.0 | | |
| $LiClO_4$ | | | | | | | | | | |
| $NaClO_3$ | | | | | | | | | | 40.6 |
| $LiClO_3$ | | | | | | | | | | 13.1 |
| $KNO_2$ | | | | | | | | | 56.4 | |
| AlkT | | | | | | | | | | |
| AE-O | 1.7 | 1.3 | 1.2 | 0.4 | | | | | | |
| OAL | | | | | | | | | | |
| AC-18D | | | | | | | | | | |
| AC-HT | | | | | | | | | | |
| AE12D | | | | | | | | | | |
| SMO | | | | | | | | | | |
| Petro AG | | | | | | | | | | |
| AE-SD | | | | | 2.0 | | | 5.1 | 3.3 | 3.6 |
| AC-T | | | | | | 2.0 | | | | |
| TA | | | | | | | 5.9 | | | |
| Petroleum Jelly | | | | | 5.0 | | | | | |
| Mineral Oil | 3.3 | 2.5 | 2.3 | 1.1 | | | 1.0 | | 3.3 | 11.1 |
| Wax | | | | | | | | | 6.5 | |
| Silicone Oil[1] | | | | | | | 5.9 | | | |
| Halogenated Oil[2] | | | | | | | | 10.1 | | |
| Synthetic Oil[3] | | | | | | 6.0 | | | | |
| Polyethylene[4] | | | | | 1.0 | | | | | |
| Powdered Al | | | | | | | | | | |
| Urea | | | | | | | | | | |
| Glycerine | | | | | | | | | | |

TABLE 1-continued

| Microcellular Compositions | | | | | | | | | | |
|---|---|---|---|---|---|---|---|---|---|---|
| MEAN | | | | 27.6 | | | | | | |
| MEAP | | | | | | | | | | |
| EDDN | 46.6 | 34.9 | 32.6 | | | | | | | |
| NQ | | | | | | | | | | |
| GN | | | | | | | | | | |
| Microballoons | | | | 1.1 | | | | | | |
| RDX | | | 30.0 | | | | | | | |
| HMX | | 25.0 | | | | | | | | |
| Density (g/cm$^3$) | 1.62 | 1.61 | 1.64 | 1.42 | 1.54 | 1.51 | 1.50 | 1.51 | 1.40 | 1.72 |
| Melting point, Oxydizer Phase (°C.) | 104.5 | 104.5 | 104.5 | 95 | 112 | 112 | 112 | 112 | 108 | 114 |
| Charge dimensions, L/D (cm/cm) | 48/7.9 | 48/7.9 | 48/7.9 | 25/7.9 | 10/6.4 | 10/6.4 | 10/6.4 | 10/6.4 | 10/6.4 | 10/6.4 |
| Initiator (Cap No) | 8 | 8 | 8 | 8 | 8 | 8 | 8 | 8 | 8 | 8 |
| Booster | 100 g Comp B | 100 g Comp B | 100 g Comp B | 100 gr/ft det cord | 50 g RDX | 50 g RDX | 50 g RDX | 50 g RDX | 50 g RDX | 50 g RDX |
| Results: VOD (km/sec) | 3.34 | 8.48 | 7.80 | 6.70 | | | | | | |
| Plate dent[5] | | | | | Pos | Pos | Pos | Pos | Pos | Pos |

Notes:
[1]General Electric, Silicone Fluid SF96-20, Lot No. KC552.
[2]Halocarbon Products Corporation, Series 56 Halocarbon Oil, Batch 84-30.
[3]Gulf Oil, Synthetic Base Fluid, Synfluid 4cSt PAD (Polyalphaolefins).
[4]Allied Corporation, Ethylene Homopolymer, Grade 617.
[5]Plate Dent:
Pos = Dent in or perforation of one half inch thich mild steel plate.
Neg = No dent in or perforation of one half inch thick mild steel plate.

We claim:

1. A castable composite explosive, propellant, flare, or gas generator, comprising in combination: a substantially water-free, stable emulsion of molten inorganic oxidizer salt(s), immiscible hydrocarbon fuel(s) and surfactant(s), the fuel(s) and surfactant(s) forming the continuous phase in which the oxidizer phase in dispersed in the form of discrete cells which solidify upon cooling without material disruption of the fuel phase continuum, the surfactants being selected for their capacity to form an emulsion at process temperatures which retains substantial fuel phase continuity during solidification, the oxidizer phase being at least 75% by weight of the emulsion, the final product being solid, firm or rigid; wherein water may be present as water of hydration or because of the hygroscopic nature of the ingredients and is limited to 3% maximum by weight of the composition.

2. A composition as claimed in claim 1 wherein the intimately mixed ingredients allow the molten oxidizer cells to supercool before solidification occurs.

3. A composition as claimed in claim 1 wherein the oxidizer cells in the solid final product are crystalline.

4. A composition as claimed in claim 1 wherein the oxidizer cells in the solid final product are amorphous.

5. A composition as claimed in claim 1 wherein the fluid emulsion can be placed in suitable containers in which the composition subsequently hardens.

6. A composition as claimed in claim 1 wherein the oxygen balance is between +5% and −30%.

7. A composition as claimed in claim 1 wherein the composition employs a metallic fuel and the oxygen balance is between +5% and −50%.

8. A composition as claimed in claim 1 wherein the surfactant concentration is from 0.05% to 15% of the composition by weight.

9. A composition as claimed in claim 1 wherein inorganic nitrates constitute the major portion of the molten oxidizer salt or mixture of salts.

10. A composition as claimed in claim 9 wherein ammonium nitrate is the principal oxidizer salt comprising not less than 40% by weight of the composition.

11. A composition as claimed in claim 10 wherein other oxidizer salts are added in conjunction with ammonium nitrate; the total concentration of the added salt or salts is limited to 55% by weight of the composition; and no single salt other than ammonium nitrate is present in concentration greater than 40% by weight of the composition.

12. A composition as claimed in claim 11 wherein the added oxidizers are selected from the group consisting of alkali and alkaline earth nitrates and perchlorates, and ammonium perchlorate.

13. A composition as claimed in claim 12 wherein the added oxidizer is selected from the group consisting of zinc nitrate, manganese nitrate, copper nitrate, lead nitrate and the perchlorate analogs.

14. A composition as claimed in claim 11 wherein oxidizer additives are the perchlorate, chlorate or nitrite analogs of the inorganic nitrates.

15. A composition as claimed in claim 11 wherein any soluble and compatible potassium salt is added to phase-stabilize ammonium nitrate.

16. A composition as claimed in claim 9 wherein lithium nitrate is the principal oxidizer salt.

17. A composition as claimed in claim 1 wherein inorganic perchlorates constitute the major portion of the molten oxidizer salt or mixture of salts.

18. A composition as claimed in claim 17 wherein lithium perchlorate is the principal oxidizer salt.

19. A composition as claimed in claim 17 wherein additives selected from the group consisting of ammonium, lithium, sodium, potassium, magnesium, calcium, strontium, barium, copper, zinc, manganese and lead perchlorates, nitrates, chlorates and nitrites are added; and the concentration of any single such additive is not more than 45% by weight of the total composition.

20. A composition as claimed in claim 17 wherein ammonium perchlorate is the additive.

21. A composition as claimed in claim 1 wherein the principal oxidizer is selected from the chlorate salts and wherein additives selected from the perchlorate, nitrite, and nitrate salts are optional.

22. A composition as claimed in claim 21 wherein lithium perchlorate is the principal oxidizer.

23. A composition as claimed in claim 1 wherein the principal oxidizer is selected from the nitrite salts and wherein additives selected from the perchlorate, nitrate, and chlorate salts are optional.

24. A composition as claimed in claim 1 wherein the fuel is polymerizable or crosslinkable and where polymerization or crosslinking or both may be accomplished in situ.

25. A composition as claimed in claim 1 wherein the fuel is a thermoplastic polymer.

26. A compositon as claimed in claim 24 wherein polymerizable fuels are selected from the group consisting of polyesters, polyethers, polydienes, polysulfides, polyperflourocarbons, polyoefins, polyamines, polyalkanes, polyphenols and polyacetylenes.

27. A composition as claimed in claim 1 wherein the hydrocarbon fuel is nonpolymerizable.

28. A composition as claimed in claim 1 wherein molten compound explosives may be employed as fuel(s), singly or in combination.

29. A composition a claimed in claim 1 wherein combinations of molten compound explosive(s) and hydrocarbon fuel(s) constitute the fuel phase of the composition.

30. A composition as claimed in claim 1 wherein the fuels are selected from the group consisting of silicones and polysiloxanes.

31. A composition as claimed in claim 1 wherein the fuels are halogenated hydrocarbons.

32. A composition as claimed in claim 1 wherein the fuels are synthetic oils.

33. A composition as claimed in claim 1 wherein the fuels are molten surfactants.

34. A composition as claimed in claim 1 wherein the surfactants form oil-continuous emulsions and are selected from those having chain lengths equal to or greater than 12 carbon atoms in length.

35. A composition as claimed in claim 1 wherein the surfactants are crystal habit modifiers which are dialkylnaphthalene sulfonates.

36. A composition as claimed in claim 1 wherein additives selected from the group consisting of aromatic and alkylaryl surfactants are employed.

37. A composition as claimed in claim 1 wherein fuels which are soluble in the oxidizer portion are employed singly or in combination.

38. A composition as claimed in claim 37 wherein the soluble fuels are compound explosives.

39. A composition as claimed in claim 38 wherein the soluble compound explosive is the nitrate or perchlorate adduct of an alkylamine or alkanolamine.

40. A composition as claimed in claim 38 wherein the soluble compound explosive is an oxidizer.

41. A composition as claimed in claim 38 wherein the oxidizer portion is comprised of molten compound explosives, singly or in combination.

42. A composition as claimed in claim 38 wherein the compound explosive is selected from the group consisting of hexamethylenetetramine nitrates and hexamethylenetetramine perchlorates.

43. A composition as claimed in claim 38 wherein the compound explosive is a nitroazole salt.

44. A composition as claimed in claim 1 wherein the originally fluid mixture is employed as a matrix into which insoluble solids or liquids may be added.

45. A composition as claimed in claim 44 wherein the added solid is a compound explosive.

46. A composition as claimed in claim 44 wherein the added solid is a metallic fuel.

47. A composition as claimed in claim 44 wherein a compound explosive which is a metal ammonia coordination compound is added.

48. A composition as claimed in claim 44 wherein insoluble molten compound explosives are dispersed in the originally fluid mixture.

49. A composition as claimed in claim 44 wherein the insoluble solid additive is an oxidizer.

50. A composition as claimed in claim 1 wherein density control or sensitization is achieved by the use of additives selected from microballoons, perlite, fumed silica, entrained gas, and gas generated in situ.

51. A method of preparing a composition as claimed in claim 1 which comprises heating the ingredients until they are molten, mixing the ingredients while in the molten state, forming a stable emulsion in which the hydrocarbon fuel forms the continuous phase and the molten oxidizer forms the discontinuous phase, imparting sufficient additional shear to achieve particle sizes small enough to maintain emulsion stability during solidification, and cooling the stable emulsion until the individual oxidizer droplets solidify as separate cells without material disruption of the fuel continuum, the final product being solid, firm or rigid.

52. A method as claimed in claim 51 wherein the additional shear imparted is sufficient to reduce the size of substantially all oxidizer phase particles to less than one micron in at least one dimension.

* * * * *